US008939194B2

(12) United States Patent
Kiyose et al.

(10) Patent No.: US 8,939,194 B2
(45) Date of Patent: Jan. 27, 2015

(54) CONTINUOUS CAST SLAB AND PRODUCING METHOD THEREFOR

(75) Inventors: Akihito Kiyose, Tokyo (JP); Toshiyuki Kajitani, Tokyo (JP); Mineo Niizuma, Tokyo (JP); Yasuhiko Otani, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 1057 days.

(21) Appl. No.: 12/737,397

(22) PCT Filed: Jul. 15, 2009

(86) PCT No.: PCT/JP2009/062808

§ 371 (c)(1), (2), (4) Date: Jan. 7, 2011

(87) PCT Pub. No.: WO2010/008019

PCT Pub. Date: Jan. 21, 2010

(65) Prior Publication Data

US 2011/0103996 A1 May 5, 2011

(30) Foreign Application Priority Data

Jul. 15, 2008 (JP) ..... 2008-183909

(51) Int. Cl.

| | |
|---|---|
| ***B22D 11/043*** | (2006.01) |
| ***B22D 11/124*** | (2006.01) |
| ***C22C 38/04*** | (2006.01) |
| ***C22C 38/08*** | (2006.01) |
| ***C22C 38/02*** | (2006.01) |
| ***C22C 38/06*** | (2006.01) |

(52) U.S. Cl.

CPC ..... *C22C 38/02* (2013.01); *B22D 11/124* (2013.01); *C22C 38/04* (2013.01); *C22C 38/06* (2013.01); *C22C 38/08* (2013.01)

USPC ..... 164/476; 164/485; 420/119

(58) Field of Classification Search

CPC ..... B22D 11/124; C22C 38/00

USPC ..... 164/485, 476; 420/91, 119

See application file for complete search history.

(56) References Cited

U.S. PATENT DOCUMENTS 5,567,250 A 10/1996 Akamatsu et al.

FOREIGN PATENT DOCUMENTS

| | | |
|---|---|---|
| JP | S58-3790 | 1/1983 |
| JP | S59-28424 | 7/1984 |
| JP | 63-063559 | 3/1988 |
| JP | 9-3597 | 1/1997 |
| JP | 9-47854 | 2/1997 |
| JP | 2885516 | 4/1999 |
| JP | 2001-138019 | 5/2001 |
| JP | 2002-307149 | 10/2002 |

OTHER PUBLICATIONS

Korean Office Action dated Oct. 9, 2012, issued in corresponding Korean Application No. 10-2011-7000828.

International Search Report dated Oct. 6, 2009 issued in corresponding PCT Application No. PCT/JP2009/062808.

Japanese Office Action dated Sep. 15, 2009 issued in corresponding Japanese Application No. 2008-183909.

Chinese Office Action dated Jul. 19, 2013 issued in corresponding Chinese Application No. 200980127329.1 [With English Translation of Search Report].

*Primary Examiner* — Kevin P Kerns

(74) *Attorney, Agent, or Firm* — Kenyon & Kenyon LLP

(57) ABSTRACT

A continuous cast slab includes the following component: by mass %, C: 0.01~0.3%, Si: 0.05~0.5%, Mn: 0.4~2%, P: 0.03% or less, S: 0.03 or less, Al: 0.005~0.03%, Ni: 0.2~2%, O: 0.006% or less, and N: 0.006% or less; wherein the balance is composed of Fe and inevitable impurities; wherein a structure in steel in a region within at least 2 mm from a broad surface is composed of ferrite and pearlite and a equivalent circular diameter of ferrite grains in the region is equal to or shorter than 30 μm.

4 Claims, 1 Drawing Sheet

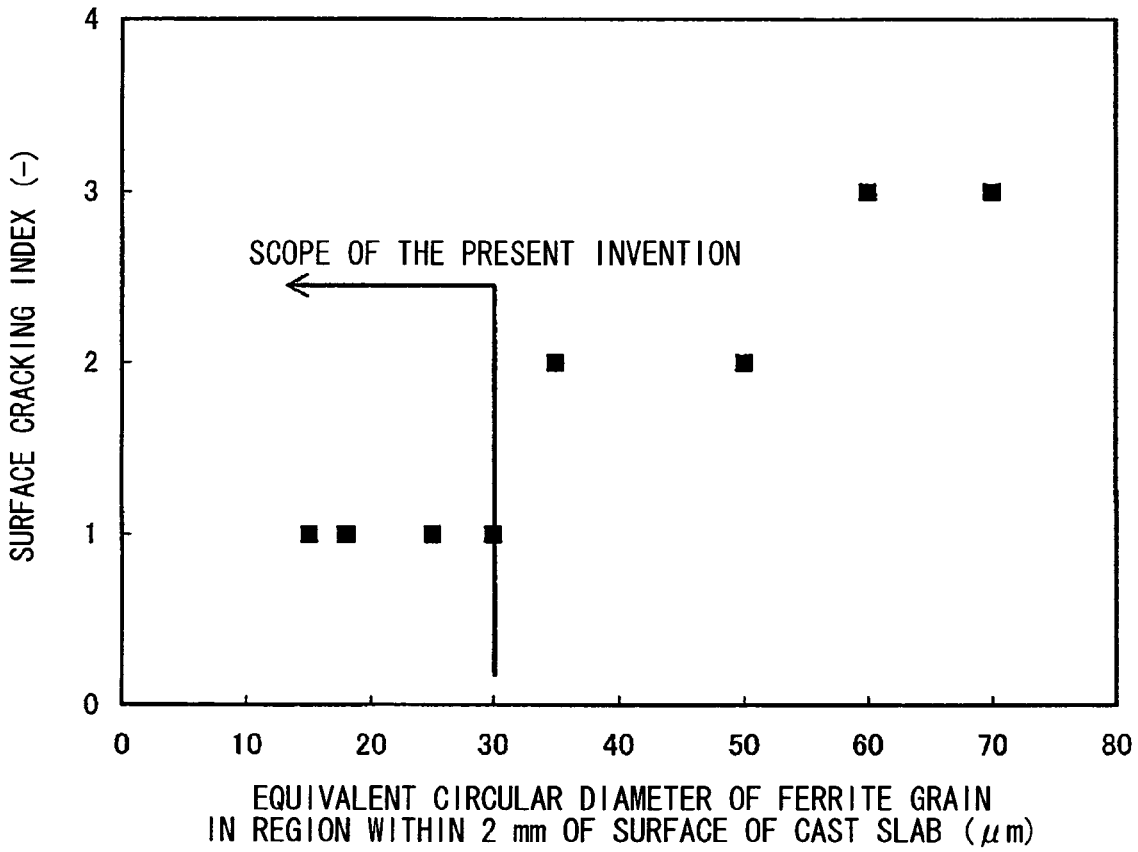
SURFACE CRACKING INDEX (-)
4
3
2
1
0
SCOPE OF THE PRESENT INVENTION
0
10
20
30
40
50
60
70
80
EQUIVALENT CIRCULAR DIAMETER OF FERRITE GRAIN
IN REGION WITHIN 2 mm OF SURFACE OF CAST SLAB (μm)

CONTINUOUS CAST SLAB AND PRODUCING METHOD THEREFOR

BACKGROUND OF THE INVENTION

1. Field of the Invention

The present invention relates to a continuous cast slab, which is Ni-added steel produced by using a vertical-bending type or a bow-type continuous casting machine and in which the appearance of surface cracks is restrained, and to a producing method therefore.

This application is a national stage application of International Application No. PCT/JP2009/062808, filed Jul. 15, 2009, which claims priority to Japanese Patent Application No. 2008-183909, filed on Jul. 15, 2008, and the content of which is incorporated herein by reference 2. Description of Related Art In general, Ni is added to steel in order to improve the toughness of the steel. However, when the Ni-added steel is cast by using a vertical-bending type or a bow-type continuous casting machine, a crack may appear on the surface of the cast slab. In this case, it is necessary to carry out a grinding treatment and the like as a post-process and as a result, the number of processes increases. Accordingly, it is necessary to prevent the appearance of the surface crack on the cast slab in order to improve the productivity of the Ni-added steel.

As a means for solving such a problem, in Japanese Unexamined Patent Application, First Publication No. H09-47854, there is disclosed a method for restraining surface cracks of a cast slab obtained by continuously casting steel. According to the restraining method, the necessary time for drawing a cast slab from a meniscus portion of molten steel in a mold to the lower end of the mold is set to within 1 minute, and the secondary cooling is carried out immediately after the drawing to cool down the surface temperature of the cast slab to the $A_3$ transformation temperature or lower within 1 minute. In addition, the surface of the cast slab at the bending point and the straightening point is reheated up to 850° C. or higher after cooling the surface of the cast slab to the $A_3$ transformation temperature or lower. According to the restraining method, straightening of the cast slab can be finished within 20 minutes after the molten steel passes through a meniscus in the mold.

In Japanese Unexamined Patent Application, First Publication No. 2002-307149, there is disclosed a continuous casting method described below. According to the continuous casting method, when a cast slab having a rectangular cross sectional shape is cast by using a bow-type or a vertical-bending type continuous casting machine, a secondary cooling of the cast slab is carried out immediately after drawing out the cast slab from a mold to cool down the surface temperature of the cast slab one time so that it reaches a temperature lower than the $Ar_3$ transformation temperature. After the secondary cooling has finished, the cast slab is reheated to a temperature exceeding the $Ar_3$ transformation temperature. After that, the cast slab is straightened. In particular, the secondary cooling of the cast slab is carried out satisfying the following Formulae (1) and (2):

$$50 \le t(s) \le 500 \quad (1)$$

$$0.13t+493 \le T_{min}(^\circ\,C.) \le 0.045t+798 \quad (2)$$

wherein, t(s) indicates a time for holding the surface temperature of the cast slab to the temperature lower than the $Ar_3$ transformation temperature, and $T_{min}$(° C.) indicates the lowest surface temperature which the surface temperature of the cast slab can reach while the cast slab is reheated to a temperature exceeding the $Ar_3$ transformation temperature after it is cooled down one time to a temperature lower than the $Ar_3$ transformation temperature. According to the secondary cooling, a solidification structure from the surface of the cast slab to at least a depth of 2 mm is composed of a mixed structure of ferrite and pearlite of which the grain boundary of the austenite is not clear.

However, according to the above-mentioned methods, the following problems may occur.

According to the method for restraining surface cracks of a cast slab obtained by continuously casting steel described in Japanese Unexamined Patent Application, First Publication No. H09-47854, a cast slab is drawn out from a mold and the cast slab is immediately subjected to a secondary cooling to cool down the surface temperature of the cast slab to the $A_3$ transformation temperature or lower within 1 minute. However, the present inventors have found that, for example, it is impossible to prevent the cracking of the cast slab at the bending point and the straightening point even when the cast slab is cooled down to 725° C. which is the lowest temperature among the temperatures disclosed in the Examples of Japanese Unexamined Patent Application, First Publication No. H09-47854. It is considered that the reason is because it was impossible to refine a structure of the surface portion of the cast slab.

According to the continuous casting method described in Japanese Unexamined Patent Application, First Publication No. 2002-307149, t(s), which indicates a time for holding the surface temperature of the cast slab to the temperature lower than the $Ar_3$ transformation temperature, and $T_{min}$(° C.), which indicates the lowest surface temperature which the surface temperature of the cast slab can reach while the cast slab is reheated to the temperature exceeding the $Ar_3$ transformation temperature after it is cooled down one time to a temperature lower than the $Ar_3$ transformation temperature, are limited to a predetermined range. According to this method, it is possible to prevent surface cracks in the cast slab.

In general, the cooling of a cast slab is classified broadly into cooling by a roll which is in contact with the cast slab and cooling by water or a mixture of water and air discharged from a nozzle disposed between the rolls. However, in a secondary cooling zone right under a mold, the cast slab is not in contact with the rolls and there is a region in the cast slab where the water or the mixture of water and air does not reach, thereby increasing the surface temperature in this region.

Accordingly, even when the cast slab is cooled down one time to a temperature lower than the $Ar_3$ transformation temperature, the cast slab is immediately reheated to a temperature exceeding the $Ar_3$ transformation temperature. Therefore, it is extremely difficult to consistently hold the cast slab to the temperature not greater than the $Ar_3$ transformation temperature for 50 seconds or longer with the general cooling facility. Because of the above-mentioned reason, the continuous casting method described in Japanese Unexamined Patent Application, First Publication No. 2002-307149 is not realistic from the industrial viewpoint.

Therefore, the present invention is to provide a continuous cast slab of Ni-added steel produced by using a vertical-bending type or a bow-type continuous casting machine, in which the appearance of surface cracks is restrained, and to provide a producing method therefor.

SUMMARY OF THE INVENTION

The main points of the present invention are as follows.

(1) A continuous cast slab includes the following component: by mass %, C: 0.01~0.3%, Si: 0.05~0.5%, Mn: 0.4~2%, P: 0.03% or less, S: 0.03 or less, Al: 0.005~0.03%, Ni: 0.2~2%, O: 0.006% or less, and N: 0.006% or less; wherein the balance is composed of Fe and inevitable impurities; wherein a structure in steel in a region within at least 2 mm from a broad surface is composed of ferrite and pearlite and a equivalent circular diameter of ferrite grains in the region is equal to or shorter than 30 μm.

(2) The continuous cast slab according to (1), wherein the continuous cast slab includes the following component: by mass %, Cu: 0.2~2%, and Cr: 0.2~2%.

(3) The continuous cast slab according to (1), wherein the continuous cast slab includes the following component: by mass %, Ti: 0.005~0.02%, Nb: 0.005~0.04%, and V: 0.005~0.04%.

(4) A method for producing a continuous cast slab, the method includes: casting continuously a molten steel including chemical components according to (1) by using a vertical-bending type or a bow-type continuous casting machine, cooling down a surface to 550° C. or lower between a mold outlet and a straightening zone; and thereafter reheating to 850° C. or higher to straighten.

When a method for producing a cast slab according to the present invention is applied, it is possible to restrain the appearance of surface cracks in Ni-added steel having high toughness produced by using a vertical-bending type or a bow-type continuous casting machine.

BRIEF DESCRIPTION OF THE DRAWINGS

FIG. 1 is a diagram showing the relationship between a surface cracking index of a cast slab and the equivalent circular diameter of ferrite grains in the region within 2 mm of the surface of the cast slab.

DETAILED DESCRIPTION OF THE INVENTION

The present inventors have eagerly examined a structure in steel in the surface portion of a cast slab (continuous cast slab) and a method for obtaining the structure in steel in order to restrain the appearance of surface cracks in a broad surface of the cast slab of Ni-added steel produced by using a vertical-bending type or a bow-type continuous casting machine.

In particular, the present inventors have paid attention to and examined the refinement of the structure in steel in the surface portion of the cast slab. As a result, the present inventors have found that when the surface portion of the cast slab has a structure composed of ferrite and pearlite, in which the equivalent circular diameter of the ferrite grains is equal to or shorter than 30 μm, it is possible to prevent the surface cracks of the cast slab of Ni-added steel.

In the structure, the grain sizes of ferrite and pearlite are substantially equal. However, as for the proportion of ferrite to pearlite, the majority of the structure is made of ferrite. Therefore, the equivalent circular diameter of the ferrite grains was defined as the index for the refinement. In addition, the present inventors also have clarified appropriate conditions for the refinement of the ferrite structure.

Detailed descriptions are as follows.

Surface cracks have been known to appear in Ni-added steel, which is produced by using a vertical-bending type or a bow-type continuous casting machine, along the austenite grain boundary when straightening a cast slab having a surface temperature of 700 to 850° C.

Therefore, the present inventors have conceived an idea that when the grain size of austenite (hereinafter, it may be referred to as a grain size of γ) is refined, the depth of cracking decreases so that it is possible to restrain the appearance of cracking to an extent that grinding is not required even when cracking appears.

In a straightening zone, since the cast slab has a high temperature, it is impossible to directly observe the grain size of γ. The structure of the cast slab observed after cooling the cast slab to room temperature is a structure mixed with ferrite and pearlite. As the grain size of the observed ferrite becomes smaller, the grain size of austenite becomes small.

In accordance with steels 1 to 9 shown in Table 1 (shown below), the relationship between the grain size of the ferrite and a surface cracking index of the cast slab has been investigated. The results are shown in FIG. 1. The grain size of ferrite varies according to a change in operation conditions shown in Table 2 (shown below). A method for calculating the equivalent circular diameter of the ferrite grains will be described below.

The surface cracking index of the cast slab has been evaluated according to the following 3-stages. In the cast slab in a stage "1", the depth of cracking is shorter than 0.2 mm. Therefore, no grinding is needed. In the cast slab in a stage "2", the depth of cracking is equal to or longer than 0.2 min and shorter than 1 mm. Therefore, grinding is needed. In the cast slab in a stage "3", the depth of cracking is equal to or longer than 1 mm. Therefore, the cast slab must be discarded. As shown in FIG. 1, it has been confirmed that the appearance of cracking is restrained when the grain size of ferrite is equal to or shorter than 30 μm.

The relationship between the grain size of austenite and the grain size of ferrite, which is transformed from the austenite cooled down to reach room temperature, has been investigated using a Formastor tester. Samples were maintained under various temperatures where the austenite can exist in a single phase to vary the grain size of the initial austenite. In addition, the relationship between the grain size of the prior-austenite, which has been rapidly cooled down to reach room temperature by spraying a He gas to the sample, and the grain size of the ferrite, which has been mildly cooled down by cooling in air, has been investigated.

The grain size of the prior-austenite and the grain size of the ferrite which has been transformed were measured. However, because of the rapid cooling, the austenite is transformed into ferrite while substantially having the grain size of the austenite. Accordingly, in the meaning of the grain size of when the ferrite was the austenite, the grain size of the ferrite is referred to as the grain size of the prior-austenite.

As a result, it has been confirmed that when the grain size of the ferrite is 30 μm, the grain size of the prior-austenite is around 200 μm. According to the present invention, since the prior-austenite grains are refined to around 200 μm, it is considered that it is possible to prevent the surface cracking.

It has been confirmed that when a ferrite grain has a size equal to or shorter than 30 μm within at least a depth of 2 mm from the broad surface of a cast slab, it is possible to prevent a great cracking needing grinding. When a region in which the grain size of ferrite is equal to or shorter than 30 μm is at a depth shorter than 2 mm from the surface of the cast slab, it is impossible to keep the depth of cracking shorter than 0.2 mm. Therefore, the range where the grain size of ferrite is equal to or shorter than 30 μm is set within at least a depth of 2 mm from the surface of the cast slab.

The equivalent circular diameter of the ferrite grains in the surface portion of the cast slab may be calculated as follows. The cast slab is cut in perpendicular to the casting direction and a sample having a depth of around 20 mm from the broad surface of the cast slab and a width of around 20 mm in the width direction of the cast slab is cut out. The surface perpendicular to the casting direction is used as an observation surface and is subjected to mirror polishing and then etching by nital, thereby revealing a structure in steel.

At this time, the structure in steel is composed of a structure mixed with ferrite and pearlite and grain sizes of the ferrite and the pearlite are substantially the same as that mentioned above.

After that, 20 ferrite grains are randomly selected, and the sizes thereof are measured to calculate an average value. The circular diameter having the same area as the average value is defined as the equivalent circular diameter of the ferrite grains. The present inventors have confirmed that around 20 ferrite grains is randomly selected, the equivalent circular diameter of the ferrite grains calculated as mentioned above becomes a representative value.

The reason why the chemical composition of the steel of the present invention is limited will be described below. Hereinafter, % represents % by mass.

C: 0.01 to 0.3%

C is indispensable as a basic element improving the strength of the base material of steel. In order to improve the strength, it is necessary to contain C in an amount equal to or more than 0.01%. However, when C is extremely contained at an amount greater than 0.3%, the toughness and weldability of the steel material may deteriorate. Therefore, the upper limit of the amount of C to be contained is set to 0.3%. Accordingly, the amount of C is 0.01 to 0.3% and preferably 0.05 to 0.2%.

Si: 0.05 to 0.5%

Si is an element which improves the strength of a steel material. In order to improve the strength, it is necessary to contain Si in an amount equal to or more than 0.05%. However, when Si is contained at an amount greater than 0.5%, the toughness in a welded heat-affected zone (HAZ) may deteriorate. Therefore, the upper limit of the amount of Si to be contained is set to 0.5%. Accordingly, the amount of Si is 0.05 to 0.5% and preferably 0.10 to 0.4%.

Mn: 0.4 to 2%

Mn is an essential element to secure the strength and toughness of the base material. In order to secure such effects, it is necessary to contain Mn in an amount equal to or more than 0.4%. However, when Mn is contained at an amount greater than 2%, the toughness considerably deteriorates. Therefore, the amount of Mn to be contained is equal to or less than 2% and preferably 0.8 to 1.5%.

P: 0.03% or less

P is an element which affects the toughness of steel. When P is contained at an amount greater than 0.03%, the toughness of a steel material considerably deteriorates. Therefore, the amount of P to be contained is set as equal to or less than 0.03% and the lower limit of the amount to be contained is 0%.

S: 0.03% or less

S is an element which affects the toughness of steel. When S is contained at an amount greater than 0.03%, the toughness of a steel material considerably deteriorates. Therefore, the amount of S to be contained is set as equal to or less than 0.03% and the lower limit of the amount to be contained is 0%.

Al: 0.005 to 0.03%

Al is an essential element for deoxidation of steel. In order to sufficiently reduce the oxygen concentration in steel, it is necessary to contain Al in an amount of at least 0.005%. However, when Al is extremely contained at an amount greater than 0.03%, not only does the deoxidation effect become insufficient but also a large amount of coarse oxides causing the deterioration of the strength and toughness of the steel material is formed. Therefore, the upper limit of the amount of Al to be contained is set to 0.03%. Accordingly, the amount of Al is 0.005 to 0.03%.

Ni: 0.2 to 2%

Ni is an element added to a steel material in order to improve the strength and toughness of the steel material. In order to improve the strength and toughness, it is necessary to contain Ni in an amount equal to or more than 0.2%. When Ni is extremely contained at an amount greater than 2%, the starting point of a grain boundary cracking appears due to the excess oxidation of the austenite grain boundary. For that reason, even when the grain size of γ is refined, it is difficult to decrease the depth of cracking. Therefore, the upper limit of the amount of Ni to be contained is set to 2%.

Accordingly, the amount of Ni is 0.2 to 2%, and preferably 0.4 to 1.8%.

O: 0.006% or less

Most of the O contained in steel exists therein as oxides. When the oxygen concentration becomes higher, the number of the oxides increases and the size of the oxides becomes coarse. When a large amount of coarse oxides exists in steel, the strength and toughness of the steel deteriorate. When the amount of O exceeds 0.006%, the number of the coarse oxides increases. Therefore, the upper limit of the amount of O to be contained is set as 0.006% and the lower limit of the amount to be contained is 0%.

N: 0.006% or less

When N is contained in steel in an amount greater than 0.006%, the toughness of the steel deteriorates. Therefore, the amount of N is set as equal to or less than 0.006%. However, since it is inevitable that N is mixed into the steel, the lower limit of the amount to be contained is not 0%.

The basic composition of the steel of the present invention contains the above-mentioned elements and the balance composed of Fe and inevitable impurities.

In addition, in order to improve the strength and toughness of a steel material, it is preferable that it contain one or more of the following elements.

Cu: 0.2 to 2%

When steel contains Cu in an amount equal to or more than 0.2%, the strength of the steel material considerably increases. However, when the amount of Cu exceeds 2%, a surface crack may readily occur due to Cu. Therefore, the amount of Cu is set to 0.2 to 2%.

Cr: 0.2 to 2%

Cr is added to steel in order to improve the strength and corrosion resistance. When Cr is contained at an amount equal to or more than 0.2%, it is possible to exhibit such properties. However, when Cr is contained at an amount greater than 2%, the toughness of the steel material readily deteriorates. Therefore, the amount of Cr is set as equal to or less than 2%. Accordingly, the amount of Cr is set to 0.2 to 2%.

In addition, in order to improve the strength and toughness of a steel material, it is preferable that it contain one or more of the following elements.

Ti: 0.005 to 0.02%

Ti is bonded with N and C to produce respectively fine TiN and TiC, thereby contributing to the improvement of the toughness of the steel material. This effect is exhibited when Ti is contained in the steel material in an amount equal to or more than 0.005%. On the other hand, when the amount of Ti exceeds 0.02%, coarse TiN and TiC are formed so that the toughness of the steel material readily deteriorates. Accordingly, the amount of Ti is set to 0.005 to 0.02%.

Nb: 0.005 to 0.04%

Due to Nb, nitrides and carbides are formed, thereby contributing to the improvement of the strength of the steel material. This effect is exhibited when Nb is contained in the steel material in an amount equal to or more than 0.005%. On the other hand, when the amount of Nb exceeds 0.04%, coarse nitrides and carbides are formed so that the strength of the steel material readily deteriorates. Accordingly, the amount of Nb is set to 0.005 to 0.04%.

V: 0.005 to 0.04%

Due to V, nitrides and carbides are formed, thereby contributing to the improvement of the strength of the steel material. This effect is exhibited when V is contained in the steel material in an amount equal to or more than 0.005%. On the other hand, when the amount of V exceeds 0.04%, coarse nitrides and carbides are formed so that the strength of the steel material readily deteriorates. Accordingly, the amount of V is set to 0.005 to 0.04%.

The above-mentioned composition is prepared in a state of molten steel before starting casting by control according to the common method. For example, each alloy element can be contained in steel by adding the elements to the molten steel during a converter process and/or a secondary refining process. At this time, pure metal and/or alloy may be used.

A continuous casting method for refining the grain size of ferrite in a surface portion of a cast slab will be described below. In order to reduce the grain size of ferrite in a surface portion of a cast slab, it is necessary to reduce the grain size of austenite at a high temperature of 850° C. or higher where a cast slab is straightened during a continuous casting.

The austenite grains in a straightening zone cannot be refined greatly simply by strongly cooling a cast slab drawn out from a mold. The size of the austenite grains is at least around 2 to 3 mm in the width direction of the cast slab. In order to refine the austenite grains to a size equal to or smaller than 200 μm to prevent surface cracking, a reverse transformation is applied inside a continuous casting machine.

That is, the cast slab drawn out from a mold is strongly cooled down one time to form ferrite. After that, the cast slab is reheated and the ferrite becomes austenite once again. Due to this reverse transformation, it is possible to refine the austenite grains. The present inventors have found that the heat history on the surface of a cast slab is important for refining the structure in the region within at least 2 mm of the surface of the cast slab by applying the reverse transformation.

By using steels 1 to 9 having chemical components as shown in Table 1, the structure and the cracking of cast slabs having various heat histories were investigated.

Between a mold outlet and a straightening zone, the surfaces of the cast slabs were cooled down to 550° C. or lower and then were reheated to 850° C. or higher to straighten the cast slabs. As a result, it has been confirmed that a structure in steel in the region within at least 2 mm from the surface of the cast slab is composed of ferrite and pearlite and it is possible to refine the grain size of the ferrite to be equal to or less than 30 μm. In addition, the present inventors have confirmed that there is no cracking of a depth equal to or larger than 0.2 mm on the surface of the cast slab.

The lower limit of the surface temperature of the cast slab between a mold outlet and a straightening zone is not particularly prescribed. However, when the surface temperature of the cast slab is equal to or lower than 480° C., it is difficult to reheat the surface of the cast slab to equal to or higher than 850° C. in the straightening zone. In addition, surface cracking may occur on the cast slab due to strong cooling. Accordingly, the surface temperature of the cast slab between the outlet of the mold and the straightening zone is preferably greater than 480° C.

In order to easily reheat the surface of the cast slab to equal to or higher than 850° C. in the straightening zone, the surface temperature of the cast slab between the outlet of the mold and the straightening zone is more preferably equal to or higher than 490° C. and further preferably equal to or higher than 500° C.

The time for cooling the surface of a cast slab to equal to or lower than 550° C. is not particularly limited. It is preferable to set the time within a suitable range capable of reheating a steel slab to equal to or higher than 850° C. in the straightening zone after the temperature of the surface of the steel slab reaches equal to or lower than 550° C.

The surface temperature of the cast slab may be measured according to a method, which includes inserting a thermocouple between rolls to be in contact with the surface of the cast slab, and a method which uses a radiation thermometer. In addition, a heat transfer equation and a solidification equation may be solved and calculated by providing heat release conditions such as cooling water and rolls.

Example 1

Molten steels including chemical components (chemical components prescribed in the present invention) of steels 1 to 9 shown in Table 1 were used. These molten steels were subjected to continuous casting respectively by using a vertical-bending type or a bow-type continuous casting machine under the condition Nos. 1 to 8 shown in Table 2, thereby obtaining cast slabs. At this time, by varying the cooling condition of a secondary cooling facility and the casting rate, the heat history on the surface of the cast slab was varied as shown in Table 2. The chemical components of the cast slabs obtained from the molten steels having the chemical components of steels 1 to 9 were not changed as shown in Table 1.

In addition, the tensile strength TS and the fracture transition temperature ${}_{v}T_{rs}$ of a steel plate obtained by flattening the cast slab were shown in Table 1. It is shown that all the steels had high strength because the steels contained Ni.

According to the method for producing a continuous cast slab of the present invention, the cooling conditions shown in Table 2 for cooling down the surface portion of the cast slab affect the surface cracking of the cast slab, but rarely affect the cooling of the inside of the cast slab. Accordingly, TS and ${}_{v}T_{rs}$, which indicate the qualities of the steel plate, do not change depending on the cooling conditions shown in Table 2.

The thus obtained cast slab was cooled down to reach room temperature. The cast slab was cut perpendicular to the casting direction and the cross sectional surface of the nearby surface of the broad surface of the cast slab was observed. 20 ferrite grains in a region within 2 mm from the surface of the cast slab were randomly selected and the equivalent circular diameter of the ferrite grains was calculated in the above-mentioned manner. As for surface cracking of the cast slab, the scale on the surface of the cast slab was removed by using a check-scarfing and then the surface of the cast slab was observed, thereby investigating the depth of cracking.

The heat history of the surface of the cast slab, the equivalent circular diameter of the ferrite grains in a region within 2 mm from the surface of the cast slab, and the surface cracking index appearing in the above-mentioned cast slab are shown in Table 2.

Nos. 1 to 4 represent the cases where the cast slab is produced according to the operation conditions prescribed in the present invention. In such cases, the lowest surface temperature of the cast slab between the mold outlet and the straightening zone was set as equal to or lower than 550° C. and the surface temperature of the cast slab at the straightening point was set as equal to or higher than 850° C. As a result, the equivalent circular diameter of the ferrite grains in a region within 2 mm of the surface of the cast slab became equal to or smaller than 30 μm and the surface cracking index of the cast slab became "1", thereby not causing problems.

Nos. 5 to 8 represent the cases where the cast slab is produced according to operation conditions not prescribed in the present invention. In Nos. 5 and 6, the lowest surface temperature of the cast slab between the outlet of the mold and the straightening zone was greater than 550° C. Therefore, the equivalent circular diameter of the ferrite grains in a region within 2 mm of the surface of the cast slab became greater than 30 μm. Accordingly, problematic cracking appeared.

In Nos. 7 and 8, the lowest surface temperature of the cast slab between the outlet of the mold and the straightening zone was equal to or lower than 550° C. However, in these cases, the surface temperature of the cast slab at the straightening point was lower than 850° C. Therefore, the equivalent circular diameter of the ferrite grains in a region within 2 mm of the surface of the cast slab became greater than 30 μm. Accordingly, problematic cracking appeared.

The depth of cracking in the cast slab of steel 10 was also investigated in the same manner as above.

In steel 10, since the Ni concentration exceeds 2%, it does not satisfy the Ni concentration range prescribed in the present invention. Under the operation conditions prescribed in the present invention such as Nos. 1 to 4 shown in Table 2, the equivalent circular diameter of the ferrite grains in a region within 2 mm of the surface of the cast slab became equal to or smaller than 30 μm. However, the steel 10 having an Ni concentration of greater than 2% had a surface cracking index of "2". Therefore, it was impossible to restrain cracking.

While preferred embodiments of the present invention have been described and illustrated above, it should be understood that these are exemplary of the present invention and are not to be considered as limiting. Additions, omissions, substitutions, and other modifications can be made without departing from the spirit or scope of the present invention. Accordingly, the present invention is not to be considered as being limited by the foregoing description, and is only limited by the scope of the appended claims.

It is possible to restrain the appearance of a surface crack in Ni-added steel having high toughness produced by using a vertical-bending type or a bow-type continuous casting machine.

TABLE 1

| | Chemical Composition (mass %) | | | | | | | | | | | | | | TS | $_vT_{rs}$ |
|---|---|---|---|---|---|---|---|---|---|---|---|---|---|---|---|---|
| Steel No. | C | Si | Mn | P | S | Al | Ni | O | N | Cu | Cr | Ti | Nb | V | MPa | ° C. |
| 1 | 0.08 | 0.20 | 1.2 | 0.020 | 0.020 | 0.025 | 0.40 | 0.0040 | 0.0040 | | | | | | 550 | −50 |
| 2 | 0.15 | 0.45 | 0.4 | 0.010 | 0.010 | 0.005 | 0.70 | 0.0060 | 0.0055 | | | | | | 600 | −55 |
| 3 | 0.10 | 0.21 | 1.0 | 0.008 | 0.005 | 0.030 | 0.70 | 0.0030 | 0.0025 | 1.50 | | | | | 600 | −75 |
| 4 | 0.25 | 0.10 | 2.0 | 0.027 | 0.003 | 0.025 | 0.80 | 0.0030 | 0.0035 | | 1.00 | | | | 560 | −80 |
| 5 | 0.10 | 0.21 | 1.0 | 0.008 | 0.026 | 0.030 | 0.70 | 0.0030 | 0.0025 | 0.30 | 0.25 | | | | 600 | −75 |
| 6 | 0.08 | 0.36 | 1.2 | 0.015 | 0.003 | 0.026 | 0.22 | 0.0035 | 0.0040 | | | 0.015 | | | 560 | −80 |
| 7 | 0.12 | 0.05 | 1.2 | 0.015 | 0.003 | 0.005 | 0.50 | 0.0050 | 0.0035 | | | | 0.035 | | 560 | −80 |
| 8 | 0.08 | 0.20 | 1.2 | 0.015 | 0.003 | 0.025 | 0.80 | 0.0030 | 0.0050 | | | | | 0.010 | 560 | −80 |
| 9 | 0.10 | 0.34 | 1.2 | 0.015 | 0.003 | 0.006 | 1.80 | 0.0045 | 0.0015 | | | 0.010 | 0.005 | 0.035 | 560 | −80 |
| 10 | 0.08 | 0.20 | 1.2 | 0.020 | 0.020 | 0.020 | 2.50 | 0.0040 | 0.0040 | | | | | | 550 | −80 |

TABLE 2

| No. | Lowest Surface Temperature of Cast Slab between Mold Outlet and Straightening Zone (° C.) | Surface Temperature of Cast Slab at Straightening Point (° C.) | Circular Equivalent Diameter of Ferrite Grains in Region within 2 mm of Surface of Cast Slab (μm) | Surface Cracking Index |
|---|---|---|---|---|
| 1 | 540 | 900 | 25 | 1 |
| 2 | 510 | 870 | 18 | 1 |
| 3 | 490 | 860 | 15 | 1 |
| 4 | 490 | 900 | 30 | 1 |
| 5 | 600 | 900 | 35 | 2 |
| 6 | 700 | 860 | 50 | 2 |
| 7 | 540 | 800 | 70 | 3 |
| 8 | 490 | 750 | 60 | 3 |

Example 2

In the same manner as above, molten steel including chemical components of steel 10 shown in Table 1 was used. The molten steel was subjected to continuous casting by using a vertical-bending type or a bow-type continuous casting machine under the condition Nos. 1 to 4 shown in Table 2, thereby obtaining a cast slab. The chemical components of the cast slab obtained from the molten steel having the chemical components of steel 10 were not changed as shown in Table 1.

What is claimed is:

1. A continuous cast steel slab comprising, by mass %,

C: 0.01-0.3%,

Si: 0.05-0.5%,

Mn: 0.4-2%,

P: 0.03% or less,

S: 0.03% or less,

Al: 0.005-0.03%,

Ni: 0.2-2%,

O:0.006% or less,

N: 0.006% or less; and a balance of Fe and inevitable impurities;

wherein a structure in the steel in a region within at least a depth of 2 mm from a broad surface of the slab is composed of ferrite and pearlite, and an equivalent circular diameter of ferrite grains in the region is equal to or shorter than 30 μm.

2. The continuous cast steel slab according to claim 1, further comprising, by mass %, Cu: 0.2-2%, and Cr: 0.2-2%.

3. The continuous cast steel slab according to claim 1, further comprising, by mass %, Ti: 0.005-0.02%, Nb: 0.005-0.04%, and

V: 0.005-0.04%.

4. A method for producing a continuous cast steel slab, the method comprising: casting continuously a molten steel comprising by mass %,

C: 0.01-0.3%,

Si: 0.05-0.5%,

Mn: 0.4-2%,

P: 0.03% or less,

S: 0.03% or less,

Al: 0.005-0.03%,

Ni: 0.2-2%,

O: 0.006% or less,

N: 0.006% or less, and a balance of Fe and inevitable impurities, using a vertical-bending or a bow continuous casting machine;

cooling down a surface of the cast steel slab to 550° C. or lower between a mold outlet and a straightening zone of the vertical-bending or the bow continuous casting machine; and thereafter reheating between the mold outlet and the straightening zone of the vertical-bending or the bow continuous casting machine to 850° C. or higher to straighten the cast steel slab.

* * * * *